US011591994B2

(12) United States Patent
Sugaya et al.

(10) Patent No.: US 11,591,994 B2
(45) Date of Patent: Feb. 28, 2023

(54) FUEL INJECTION DEVICE

(71) Applicant: Hitachi Automotive Systems, Ltd., Hitachinaka (JP)

(72) Inventors: Masashi Sugaya, Hitachinaka (JP); Takao Miyake, Hitachinaka (JP); Yasuo Namaizawa, Hitachinaka (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 48 days.

(21) Appl. No.: 16/652,758

(22) PCT Filed: Oct. 31, 2018

(86) PCT No.: PCT/JP2018/040452
§ 371 (c)(1),
(2) Date: Apr. 1, 2020

(87) PCT Pub. No.: WO2019/102806
PCT Pub. Date: May 31, 2019

(65) Prior Publication Data

US 2020/0232433 A1 Jul. 23, 2020

(30) Foreign Application Priority Data

Nov. 22, 2017 (JP) ..... JP2017-225012

(51) Int. Cl.
*F02M 61/20* (2006.01)
*F02M 61/04* (2006.01)
*B05B 1/30* (2006.01)

(52) U.S. Cl.
CPC ..... *F02M 61/04* (2013.01); *B05B 1/3053* (2013.01); *F02M 61/20* (2013.01)

(58) Field of Classification Search
CPC ..... F02M 61/04; F02M 61/20–205; F02M 2200/50
See application file for complete search history.

(56) References Cited

U.S. PATENT DOCUMENTS 2,352,682 A * 7/1944 Blanding ..... F02M 61/04 123/590
2,960,998 A * 11/1960 Sinker ..... F16K 15/063 137/542

(Continued)

FOREIGN PATENT DOCUMENTS

CN 102985736 A 3/2013
DE 102015217516 A1 3/2017

(Continued)

OTHER PUBLICATIONS

Office Action issued in corresponding Chinese Patent Application No. 201880073676.X dated Sep. 17, 2021.

(Continued)

*Primary Examiner* — Joseph A Greenlund
(74) *Attorney, Agent, or Firm* — Foley & Lardner LLP

(57) ABSTRACT

For a fuel injection device, a configuration to improve fuel sealability when a valve is closed is provided. Therefore, the fuel injection device includes: a valve body that opens and closes a fuel flow path; a movable iron core in which a fuel passage hole communicating an upstream side and a downstream side is formed, and that operates the valve body toward the upstream side; a biasing spring whose one end contacts the movable iron core, and that biases the movable iron core in a valve opening direction; and a regulating unit that regulates movement of the one end of the biasing spring, in which the shortest distance between the one end of the biasing spring and the fuel passage hole is larger than a radial travel distance of the one end until radial movement of the one end is regulated by the regulating unit.

5 Claims, 3 Drawing Sheets

(56) References Cited

U.S. PATENT DOCUMENTS 3,800,825 A * 4/1974 Zoll ..... F16K 31/58 137/454.2
4,077,619 A * 3/1978 Borlinghaus ..... F16F 1/04 267/248
4,111,407 A * 9/1978 Stager ..... F16F 1/08 267/166.1
4,947,893 A * 8/1990 Miller ..... F16K 31/0613 137/625.65
5,104,091 A * 4/1992 Rathay ..... F16K 11/048 137/596.17
5,217,204 A * 6/1993 Maier ..... F02M 61/168 123/472
5,606,991 A * 3/1997 Kuribayashi ..... F02M 69/54 123/463
5,615,870 A * 4/1997 Balsells ..... F16F 1/045 267/167
5,921,475 A * 7/1999 DeVriese ..... F02M 61/20 239/585.4
5,996,619 A * 12/1999 Saur ..... F01P 7/14 251/118
8,205,858 B2 * 6/2012 Mueller ..... G05D 16/2022 303/119.2
8,672,239 B2 * 3/2014 Ogura ..... F02M 51/0685 239/596
10,267,283 B2 * 4/2019 Yasukawa ..... F02M 51/0685
10,280,887 B2 * 5/2019 Kato ..... F02M 61/1833
10,302,054 B2 * 5/2019 Kaneta ..... F02M 61/1866
10,309,360 B2 * 6/2019 Falaschi ..... F02M 61/20
10,584,667 B2 * 3/2020 Fujii ..... F16K 27/0209
2005/0197223 A1 * 9/2005 Namie ..... F16H 7/0848 474/110
2010/0320293 A1 * 12/2010 Ogura ..... F02M 51/0685 239/533.12
2013/0075501 A1 * 3/2013 Miyake ..... F02M 51/0671 239/585.3
2015/0260135 A1 * 9/2015 Izzo ..... F02M 51/0664 239/585.5
2015/0267665 A1 * 9/2015 Abe ..... F02M 61/12 239/585.1
2017/0122274 A1 * 5/2017 Fujii ..... F16K 15/026
2017/0370340 A1 * 12/2017 Falaschi ..... F02M 61/20
2018/0030943 A1 * 2/2018 Kato ..... F02M 61/1833
2018/0163685 A1 6/2018 Yasukawa
2018/0252192 A1 * 9/2018 Sugaya ..... F02M 51/06
2019/0211767 A1 * 7/2019 Miyake ..... F02D 41/20
2019/0211789 A1 * 7/2019 Zankl ..... F16K 15/044
2019/0249631 A1 * 8/2019 Miyamoto ..... F02M 61/20
2020/0165998 A1 * 5/2020 Miyake ..... F02M 51/0614
2020/0232433 A1 * 7/2020 Sugaya ..... F02M 61/04

FOREIGN PATENT DOCUMENTS

EP 1557559 A1 7/2005
EP 3141737 A1 3/2017
JP 2004-211580 A 7/2004
JP 2009-275697 A 11/2009
JP 2013-108432 A 6/2013
JP 2014-25419 A 2/2014
JP 2016-156320 A 9/2016
JP 2017-14921 A 1/2017

OTHER PUBLICATIONS

International Search Report with English translation and Written Opinion issued in corresponding application No. PCT/JP2018/040452 dated Feb. 19, 2019.

* cited by examiner

FUEL INJECTION DEVICE

TECHNICAL FIELD

The present invention relates to a fuel injection device that is used in an internal combustion engine in order to mainly inject fuel.

BACKGROUND ART

As a background art of the present technical field, there is JP 2017-14921 A. In this publication, a fuel injection valve is described, in which: a magnetic path is formed such that a magnetic flux circulates around a fixed iron core, a movable iron core, a housing, and a large-diameter portion of a cylindrical member; the movable iron core is attracted toward the fixed iron core by a magnetic attraction force generated by the magnetic flux flowing between a lower end surface of the fixed iron core and an upper end surface of the movable iron core; in the center of the movable iron core, a recess recessed from the upper end surface toward the lower end surface is formed; in the upper end surface and a bottom surface of the recess, a fuel passage hole is formed as a fuel passage penetrating to the lower end surface in a direction along the central axis line; and an upper end portion of a second spring contacts a lower surface of the movable iron core and a lower end portion of the second spring contacts a stepped portion of a nozzle body, so that the movable iron core is biased upward.

CITATION LIST

Patent Literature

PTL 1: JP 2017-14921 A

SUMMARY OF INVENTION

Technical Problem

In the fuel injection valve described in the above JP 2017-14921 A, the lower end portion of the second spring that biases the movable iron core upward contacts the stepped portion of the nozzle body.

If this second spring is placed, for example, on a plane perpendicular to the spring axis direction with the spring axis direction of the second spring kept in the vertical direction, a winding end portion of the lower end portion of the second spring first contacts the plane. A step corresponding to the wire diameter of the second spring is usually created in the winding end portions of the upper end portion and lower end portion of the second spring. Therefore, if the second spring is placed on a plane perpendicular to the spring axis direction with the second spring kept in the vertical direction, the spring axis direction of the second spring is inclined from the vertical direction to a direction opposite to the winding end portion due to the step of the winding end portion of the lower end portion.

The fuel passage hole is formed in the movable iron core, and if the second spring is arranged to be inclined as described above, the winding end portion of the upper end portion of the second spring reaches the fuel passage hole in the lower end surface of the movable iron core, creating the fear that the winding end portion may be caught inside the fuel passage hole.

As the movable iron core moves in the vertical direction, the upper end portion of the second spring that contacts the lower end surface of the movable iron core also and similarly moves in the vertical direction. The second spring changes its length by twisting itself while moving in the vertical direction.

As described above, if the upper end portion of the second spring is caught inside the fuel passage hole, the movable iron core is made eccentric by a force generated with the second spring twisting itself, so that uneven wear is caused in the sliding portion between the movable iron core and a valve body. Thereby, the movable iron core and the valve body are fixed together and moves integrally, so that an impact force on a valve seat, occurring when the valve is closed, increases. Also, there is the problem that bias contact may be caused in the fuel seal portion between the valve body and the valve seat by the uneven wear of the sliding portion, which deteriorates fuel sealability.

Therefore, an object of the present invention is to provide a configuration of a fuel injection device that improves fuel sealability when a valve is closed.

Solution to Problem

In order to solve the above problems, the present invention includes: a valve body that opens and closes a fuel flow path; a movable iron core in which a fuel passage hole for communicating an upstream side and a downstream side is formed, and that operates the valve body toward the upstream side; a biasing spring whose one end contacts the movable iron core, and that biases the movable iron core in a valve opening direction; and a regulating unit that regulates movement of the one end of the biasing spring, in which the shortest distance between the one end of the biasing spring and the fuel passage hole is larger than a radial travel distance of the one end until radial movement of the one end is regulated by the regulating unit.

Also, the present invention includes: a valve body that opens and closes a fuel flow path; a movable iron core that operates the valve body toward an upstream side; and a biasing spring that is formed such that its outer diameter is reduced from a lower end portion toward an upper end portion, and that biases the movable iron core toward the upstream side with the upper end portion contacting a lower end surface of the movable iron core.

Advantageous Effects of Invention

According to the present invention configured as described above, the stabilization of fuel sealability, when a valve is closed during long-term use of the fuel injection device, can be promoted.

Objects, configurations, and advantageous effects other than those described above will be clarified by the following description of embodiments.

DESCRIPTION OF EMBODIMENTS

Hereinafter, embodiments of the present invention will be described with reference to the drawings.

First Embodiment

Figure 1:
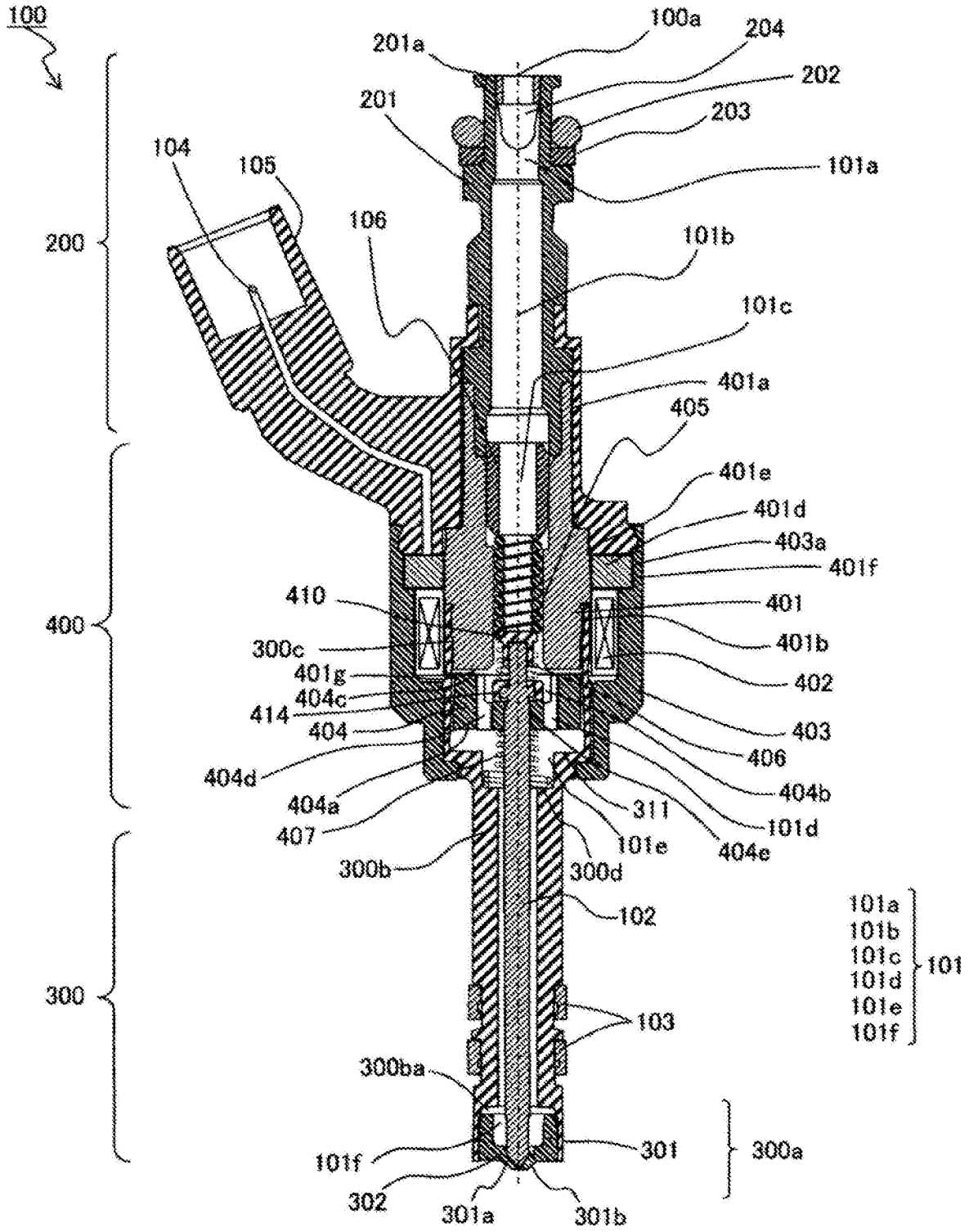
FIG. 1 is a cross-sectional view illustrating a structure of a fuel injection device according to a first embodiment of the present invention, and is a longitudinal cross-sectional view illustrating a cut surface parallel to a central axis line 100*a*.
Figure 2:
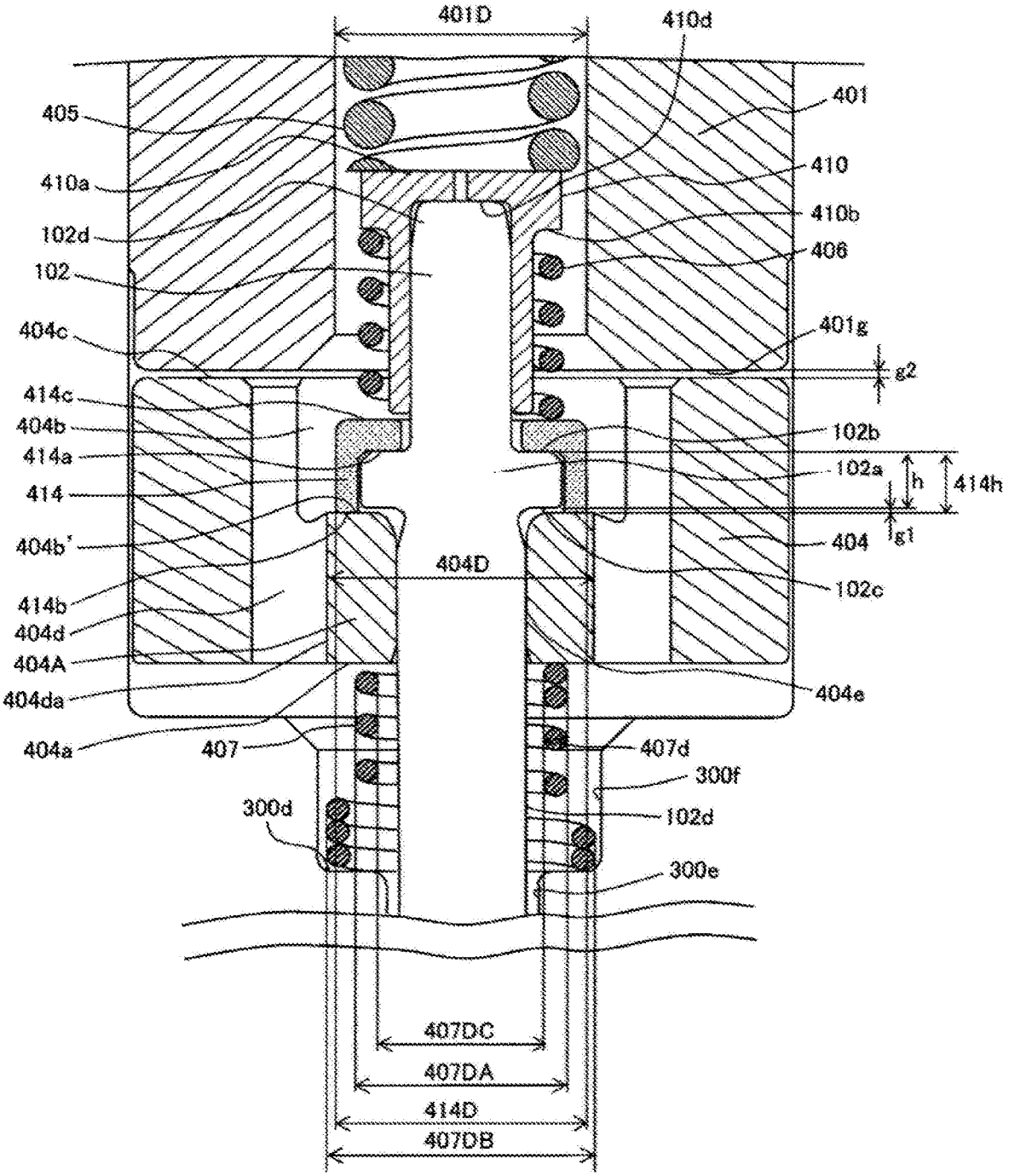
FIG. 2 is a view for explaining the vicinity of a movable iron core of the fuel injection device according to the first embodiment of the present invention, and is a cross-sectional view illustrating in an enlarged manner an electromagnetic drive unit of the fuel injection device illustrated in FIG. 1.

The configuration of a fuel injection device 100 according to a first embodiment of the present invention will be described with reference to FIGS. 1 and 2. FIG. 1 is a cross-sectional view illustrating a structure of a fuel injection device according to the first embodiment of the present invention, and is a longitudinal cross-sectional view illustrating a cut surface parallel to a central axis line 100*a*. FIG. 2 is a cross-sectional view illustrating in an enlarged manner an electromagnetic drive unit 400 of the fuel injection device 100 illustrated in FIG. 1. In FIG. 2, hatching of a valve body 102 is omitted for easy viewing.

The fuel injection device 100 is configured to include: a fuel supply unit 200 that supplies fuel; a nozzle unit 300 at the tip portion of which a valve unit 300*a* for allowing and blocking the flow of the fuel is provided; and the electromagnetic drive unit 400 that drives the valve unit 300*a*.

In the present embodiment, the case, where the fuel injection device 100 is an electromagnetic fuel injection device for an internal combustion engine using gasoline as fuel, will be described as an example. Herein, the fuel supply unit 200, the valve unit 300*a*, the nozzle unit 300, and the electromagnetic drive unit 400 indicate corresponding portions of the cross section illustrated in FIG. 1, which do not indicate a single part.

The fuel injection device 100 of the present embodiment is configured with: the fuel supply unit 200 provided on the upper end side in FIG. 1; the nozzle unit 300 provided on the lower end side; and the electromagnetic drive unit 400 provided between the fuel supply unit 200 and the nozzle unit 300. That is, the fuel supply unit 200, the electromagnetic drive unit 400, and the nozzle unit 300 are arranged in this order along the direction of the central axis line 100*a*.

The end portion of the fuel supply unit 200, opposite to the nozzle unit 300, is connected to a non-illustrated fuel pipe. The end portion of the nozzle unit 300, opposite to the fuel supply unit 200, is inserted into a mounting hole (insertion hole) formed in a non-illustrated intake pipe or a combustion chamber forming member (cylinder block, cylinder head, etc.) of the internal combustion engine.

The fuel injection device 100 receives supply of fuel from the fuel pipe through the fuel supply unit 200, and injects the fuel from the tip portion of the nozzle unit 300 into the intake pipe or the combustion chamber. Inside the fuel injection device 100, a fuel passage 101 (101*a* to 101*f*) is formed such that the fuel flows substantially along the direction of the central axis line 100*a* of the fuel injection device 100 from the end portion (end portion opposite to the nozzle unit 300) of the fuel supply unit 200 to the tip portion (end portion facing the intake pipe or the inside of the combustion chamber) of the nozzle unit 300.

In the following description, of both end portions in the direction along the central axis line 100*a* of the fuel injection device 100, the end portion or the end portion side of the fuel supply unit 200, located on the opposite side to the nozzle unit 300, is referred to as a base end portion or a base end portion side, while the end portion or the end portion side of the nozzle unit 300, located on the opposite side to the fuel supply unit 200, is referred to as a tip portion or a tip portion side. Additionally, each unit constituting the fuel injection device 100 will be described by attaching "up" or "down" based on the vertical direction in FIG. 1. This is done for easy understanding of description, which does not limit the mounting form of the fuel injection device 100 on the internal combustion engine to this vertical direction.

(Configuration Description)

Hereinafter, the configurations of the fuel supply unit 200, the electromagnetic drive unit 400, and the nozzle unit 300 will be described in detail.

The fuel supply unit 200 includes a fuel pipe 201. A fuel supply port 201*a* is provided at one end portion (upper end portion) of the fuel pipe 201, and the fuel passage 101*a* is formed inside the fuel pipe 201 so as to penetrate in the direction along the central axis line 100*a*. The other end portion (lower end portion) of the fuel pipe 201 is joined to one end portion (upper end portion) of a fixed iron core 401.

An O-ring 202 and a backup ring 203 are provided on the outer peripheral side of the upper end portion of the fuel pipe 201.

The O-ring 202 functions as a seal for preventing fuel leakage when the fuel supply port 201*a* is attached to the fuel pipe. The backup ring 203 is for backing up the O-ring 202. The backup ring 203 may be configured by stacking a plurality of ring-shaped members. A filter 204 is provided inside the fuel supply port 201*a* in order to filter foreign substances mixed in the fuel.

The nozzle unit 300 includes a nozzle body 300*b*, and the valve unit 300*a* is provided at the tip portion (lower end portion) of the nozzle body 300*b*. The nozzle body 300*b* is a hollow cylindrical body, and constitutes the fuel passage 101*f* on the upstream side of the valve unit 300*a*. A movable iron core receiving unit 311 is provided in the fuel passage 101*e* below the electromagnetic drive unit 400. A tip seal 103, for maintaining airtightness when the fuel injection device is mounted on the internal combustion engine, is provided on the outer peripheral surface of the tip portion of the nozzle body 300*b*.

The valve unit 300*a* includes an injection hole forming member 301, a guide unit 302, and the valve body 102.

The injection hole forming member 301 is configured to include a valve seat 301*a* that seals fuel by contacting the valve body 102, and a fuel injection hole 301*b* from which fuel is injected. The injection hole forming member 301 is fixed by being inserted into a recess inner peripheral surface 300*ba* formed at the tip portion of the nozzle body 300*b*. In this case, the outer periphery of the tip surface of the injection hole forming member 301 and the inner periphery of the tip surface of the nozzle body 300*b* are welded together, whereby fuel is sealed.

The guide unit 302: is located on the inner peripheral side of the injection hole forming member 301; constitutes a guide surface on the tip portion side (lower end portion side) of the valve body 102; and guides the travel of the valve body 102 in the direction along the central axis line 100*a* (valve opening and closing direction).

The electromagnetic drive unit 400 is configured to includes the fixed iron core 401, a coil 402, a housing 403, a movable iron core 404, an intermediate member 414, a plunger cap 410, a first spring member 405, a third spring member 406, and a second spring member 407. The fixed iron core 401 is also referred to as a fixed core. The movable iron core 404 is also referred to as a movable core, a mover, or an armature.

The fixed iron core 401 has the fuel passage 101*c* at its center, and has a joint portion 401*a* where it is joined to the fuel pipe 201. An outer peripheral surface 401*b* of the fixed iron core 401 is fitted and joined to a large-diameter portion 300*c* of the nozzle body 300*b*, and an outer peripheral surface 401*e* having a larger diameter than the outer peripheral surface 401*b* is fitted and joined to an outer peripheral side fixed iron core 401*d*. The coil 402 is wound around the outer peripheries of the fixed iron core 401 and the large-diameter portion 300*c* of the cylindrical member.

The housing 403 is provided to surround the outer peripheral side of the coil 402, and constitutes the outer periphery of the fuel injection device 100. An inner peripheral surface 403*a* on the upper end side of the housing 403 is connected to an outer peripheral surface 401*f* of the outer peripheral side fixed iron core 401*d*.

The movable iron core 404 is arranged on the side of a lower end surface 401*g* of the fixed iron core 401. An upper end surface 404*c* of the movable iron core 404 faces, in a valve closed state, the lower end surface 401*g* of the fixed iron core 401 with a gap g2 interposed therebetween (see FIG. 2). Also, the outer peripheral surface of the movable iron core 404 faces the inner peripheral surface of the large-diameter portion 300*c* of the nozzle body 300*b* via a slight gap, and the movable iron core 404 is provided inside the large-diameter portion 300*c* of the cylindrical member so as to be movable in the direction along the central axis line 100*a*.

A magnetic path is formed such that a magnetic flux circulates around the fixed iron core 401, the movable iron core 404, the housing 403, and the large-diameter portion 300*c* of the cylindrical member. The movable iron core 404 is attracted toward the fixed iron core 401 by a magnetic attraction force generated by the magnetic flux flowing between the lower end surface 401*g* of the fixed iron core 401 and the upper end surface 404*c* of the movable iron core 404.

In the center of the movable iron core 404, a recess 404*b* recessed from the upper end surface 404*c* toward a lower end surface 404*a* is formed. In the upper end surface 404*c* and a bottom surface 404*b*' (see FIG. 2) of the recess 404*b*, a fuel passage hole 404*d* communicating the upstream side and the downstream side is formed as the fuel passage 101*d* penetrating to the lower end surface 404*a* in the direction along the central axis line 100*a*. Also, in the bottom surface 404*b*' of the recess 404*b*, a through hole 404*e*, penetrating to the lower end surface 404*a* in the direction along the central axis line 100*a*, is formed. The valve body 102 for opening and closing the fuel flow path is provided to pass through the through hole 404*e*, and the movable iron core 404 operates the valve body 102 toward the upstream side. The plunger cap 410 is fixed to the valve body 102 by fitting, and the valve body 102 has a large-diameter portion 102*a* (see FIG. 2).

The intermediate member 414 is a cylindrical member having the recess 404*b* that is a step between the inner periphery and the outer periphery, and of the lower side surfaces, a surface 414*a* (see FIG. 2) on the inner peripheral side is made contact an upper surface 102*b* (see FIG. 2) of the large-diameter portion 102*a* of the valve body 102, while of the lower side surfaces, a surface 414*b* on the outer peripheral side is made contact the bottom surface 404*b*' of the recess 404*b* of the movable iron core 404.

A gap g1 is provided between the lower surface 102*c* (see FIG. 2) of the large-diameter portion 102*a* of the valve body 102 and the bottom surface 404*b*' of the recess 404*b* of the movable iron core 404 (see FIG. 2). The length, obtained by subtracting a height h (see FIG. 2) between the upper surface 102*b* and the lower surface 102*c* of the large-diameter portion 102*a* of the valve body 102 from a height 414*h* (see FIG. 2) of the step of the recess of the intermediate member 414, is the gap g1 described above.

The upper end portion of the first spring member 405 contacts the lower end surface of a spring force adjusting member 106, the lower end portion of the first spring member 405 contacts an upper spring receiver 410*a* (see FIG. 2) of the plunger cap 410, and the first spring member 405 biases the valve body 102 downward via the plunger cap 410.

The upper end portion of the third spring member 406 contacts a lower spring receiver 410*b* (see FIG. 2) of the plunger cap 410, the lower end portion of the third spring member 406 contacts an upper surface 414*c* (see FIG. 2) of the intermediate member 414, and the third spring member 406 biases the intermediate member 414 in the valve closing direction.

The upper end portion of the second spring member 407 contacts the lower end surface 404*a* of the movable iron core 404, the lower end portion of the second spring member 407 contacts the bottom surface 300*d* of the nozzle body 300*b*, and the second spring member 407 biases the movable iron core 404 in the valve opening direction.

That is, a solenoid valve (fuel injection device 100) of the present embodiment includes: the first spring member 405 that biases the valve body 102 in the valve closing direction; third spring member 406 that is attached to the plunger cap 410 or the valve body 102 so as to bias the intermediate member 414 in a direction in which a preliminary stroke gap (g1) is increased; and the second spring member 407 that biases the movable iron core 404 in the valve opening direction, in which the spring force of the first spring member 405> the spring force of the third spring member 406> the spring force of the second spring member 407. Thereby, the preliminary stroke gap (g1) is formed in the valve closed state.

The coil 402 is attached to the fixed iron core 401 and the outer periphery of the large-diameter portion 300*c* of the nozzle body 300*b*, a cylindrical member, in the state of being wound around a non-illustrated bobbin, and a resin material is molded therearound. With the resin material used in the molding, a connector 105 having a terminal 104 drawn out of the coil 402 is integrally formed.

Herein, the fuel injection device 100 of the present embodiment includes: the valve body 102 that opens and closes the fuel flow path; and the movable iron core 404 that operates the valve body 102 toward the upstream side (valve opening direction). And, the second spring member 407 is formed such that its outer diameter is reduced from the lower end portion toward the upper end portion, and the upper end surface of the second spring member 407 contacts the lower end surface 404*a* of the movable iron core 404, as illustrated in FIG. 2, whereby the movable iron core 404 is biased toward the upstream side.

With the configuration of the present embodiment, the upper end portion of the second spring member 407 is located radially inward with respect to the fuel passage hole 404*d* of the movable iron core 404, whereby the upper end portion of the second spring member 407 can be prevented from overlapping the fuel passage hole 404*d* of the movable iron core 404, so that the upper end portion can be prevented from being caught by the fuel passage hole 404*d*. Thereby, the upper end portion of the second spring member 407 does not overlap the lower surface of the fuel passage hole 404*d* even if the second spring member 407 is arranged such that its spring axis direction is inclined from the vertical direction to the direction opposite to the winding end portion, and hence the movable iron core 404 can be suppressed from being eccentric as before. Therefore, uneven wear of the sliding portion between the movable iron core 404 and the valve body 102 can be suppressed, and as a result, fuel sealability can be suppressed from deteriorating.

The fuel passage hole 404*d* communicating the upstream side and the downstream side is formed in the movable iron core 404, and the upper end portion of the second spring member 407 contacts the radial inside of the fuel passage hole 404*d*. More specifically, the upper end portion of the second spring member 407 contacts the lower end surface 404*a* of an inner diameter portion 404A (see FIG. 2) of the movable iron core 404, the inner diameter portion 404A being located radially inward with respect to the fuel passage hole 404*d*. In this case, the biasing spring (second spring member 407) is configured such that an outer diameter portion 407DA (see FIG. 2) of the upper end portion contacts at a position corresponding to the radial center of the inner diameter portion 404A of the movable iron core 404 (center position of the lower end surface 404*a* between the innermost peripheral position and the outermost peripheral position of the lower end surface 404*a*). With this configuration, the upper end portion of the second spring member 407 can be surely prevented from overlapping the fuel passage hole 404*d* of the movable iron core 404, so that the upper end portion can be prevented from being caught by the fuel passage hole 404*d*.

The lower end portion of the second spring member 407 holds the valve body 102 on the inner peripheral side, and contacts the bottom surface 300*d* of a stepped portion 300*f* (see FIG. 2) of the nozzle body 300*b*. That is, the fuel injection device 100 of the present embodiment holds the valve body 102 on the inner peripheral side, and includes a holding member (nozzle body 300*b*) having the stepped portion 300*f* that holds the biasing spring (second spring member 407) on the inner peripheral side, whereby the lower end portion of the biasing spring (second spring member 407) is brought into contact with and supported by the bottom surface 300*d* of the stepped portion 300*f*. Further, the biasing spring (second spring member 407) is configured such that an outer diameter portion 407DB (see FIG. 2) of the lower end portion contacts the bottom surface 300*d* of the stepped portion 300*f* of the holding member (nozzle body 300*b*) at a position corresponding to the inner diameter portion 404A of the movable iron core 404. That is, the lower end of the second spring member 407 is configured not to fall into a small inner diameter 300*e* (see FIG. 2) of the nozzle body 300*b* and the outer diameter portion 407DB of the lower end portion of the second spring member 407 is not made bigger than necessary, which reduce the processing amount of the nozzle body 300*b* and the material that constitutes the second spring member 407. Similarly, by not making the outer diameter portion 407DB of the lower end portion of the second spring member 407 bigger than necessary, the difference between the outer diameter of the outer diameter portion 407DB of the lower end portion and the outer diameter of the outer diameter portion 407DA of the upper end portion of the second spring member 407 is reduced, and hence a variation of load generated in the range where the diameters of the upper end portion and the lower end portion are switched to each other can be reduced, and as a result, a variation of load in the second spring member 407 can be reduced.

Again, there is provided a biasing spring (second spring member 407) by which the shortest distance between the upper end portion of the second spring member 407 and an inner diameter 404D of the fuel passage hole of the movable iron core 404 is formed to be larger than a radial travel distance of the upper end portion of the second spring member 407 until radial movement of the upper end portion is regulated by the regulating unit. When the upper end portion of the biasing spring (second spring member 407) is located radially inside the fuel passage hole 404*d*, the regulating unit is an outer peripheral portion 102*d* (see FIG. 2) of the valve body 102, and the biasing spring (second spring member 407) is formed such that the shortest distance between the outer diameter portion 407DA of the upper end portion of the second spring member 407 and the innermost peripheral portion 404*da* of the exit surface of the fuel passage hole 404*d* is larger than the radial travel distance between an inner peripheral portion 407DC (see FIG. 2) of the upper end portion of the second spring member 407 and the outer peripheral portion 102*d* of the valve body 102. Further, the biasing spring is formed such that when the central axis of the biasing spring (second spring member 407) and the central axis of the valve body 102 are on the same axis line and when the upper end portion of the second spring member 407 moves radially, the shortest distance between the upper end portion of the second spring member 407 and the inner diameter 404D of the fuel passage hole of the movable iron core 404 is larger than the radial travel distance of the second spring member 407. Further, with the fuel injection device 100 of the present embodiment, the biasing spring (second spring member 407) is formed such that its outer diameter is reduced from its lower end portion toward its upper end portion.

With the configuration of the present embodiment, the upper end portion of the second spring member 407 is located radially inward with respect to the fuel passage hole 404*d* of the movable iron core 404, whereby the upper end portion of the second spring member 407 can be prevented from overlapping the fuel passage hole 404*d* of the movable iron core 404, so that the upper end portion can be prevented from being caught by the fuel passage hole 404*d*. Thereby, the upper end portion of the second spring member 407 does not overlap the lower surface of the fuel passage hole 404*d* even if the second spring member 407 is arranged such that its spring axis direction is inclined from the vertical direction toward a direction going to the portion opposite to the winding end portion, and hence the movable iron core 404 can be suppressed from being eccentric. Therefore, uneven wear of the sliding portion between the movable iron core 404 and the valve body 102 can be suppressed, and as a result, fuel sealability can be suppressed from deteriorating.

Further, the biasing spring (second spring member 407) is formed such that the axial length of a small-diameter portion (upper end portion), having an outer diameter smaller than the outer diameter of the stepped portion (lower end portion) having the largest outer diameter, is larger than the axial length of the stepped portion. That is, in the fuel injection device 100 of the present embodiment, the second spring member 407 is formed such that the axial length of the outer diameter portion 407DA of the upper end portion is larger than the axial length of the outer diameter portion 407DB of the lower end portion. Thereby, the material of the spring (second spring member 407) can be reduced. Further, in manufacturing, the outer diameter portion 407DA of the upper end portion can be easily fixed in the assembly process of the second spring member 407 in which the outer diameter portion 407DA is fixed and transported.

(Operation Description)

Next, the operation of the fuel injection device 100 according to the present embodiment and features of the present invention will be described. These will be mainly described with reference to FIG. 2 that is an enlarged view of the electromagnetic drive unit 400.

(Valve Closed State Definition, Gap Description)

In a valve closed state in which the coil 402 is not powered, the valve body 102 contacts the valve seat 301*a* and is closed by a force obtained by subtracting the biasing force of the second spring member 407 from the biasing forces of the first spring member 405 and the third spring member 406 that bias the valve body 102 in the valve closing direction. This state is referred to as a valve-closed stationary state. In this case, the movable iron core 404 contacts the surface 414*b* on the outer peripheral side of the intermediate member 414, and is arranged at a valve closed position. In the valve closed state in the fuel injection device 100 of the present embodiment, a gap that is related to a valve opening operation and to a movable part is configured as follows. The gap g1 is provided between the bottom surface 404*b*' of the recess 404*b* of the movable iron core 404 and the lower surface 102*c* of the large-diameter portion 102*a* of the valve body 102.

(Operation after Powering on)

After the coil 402 is powered, a magnetomotive force is generated by an electromagnet including the fixed iron core 401, the coil 402, and the housing 403. With this magnetomotive force, a magnetic flux flows, the magnetic flux circulating around a magnetic path including the fixed iron core 401, the housing 403, the large-diameter portion 300*c* of the nozzle body 300*b*, and the movable iron core 404 that are configured to surround the coil 402. At this time, a magnetic attraction force acts between the upper end surface 404*c* of the movable iron core 404 and the lower end surface 401*g* of the fixed iron core 401, so that the movable iron core 404 and the intermediate member 414 are displaced toward the fixed iron core 401. Thereafter, the movable iron core 404 is displaced by g1 at which it contacts the lower surface 102*c* of the large-diameter portion 102*a* of the valve body 102. At this time, the valve body 102 does not move.

Thereafter, when the movable iron core 404 contacts the lower surface 102*c* of the large-diameter portion 102*a* of the valve body 102, the valve body 102 receives an impact force from the movable iron core 404 and is pulled up, so that the valve body 102 moves away from the valve seat 301*a*. Thereby, a gap is generated between the valve body 102 and the valve seat 301*a*, and the fuel injection hole 301*b*, a fuel passage, is opened. Since the valve body 102 starts opening on receiving the impact force from the movable iron core 404, the rise of the valve body 102 becomes steep. At this time, the movable iron core 404 and the intermediate member 414 operate in the same manner as the valve body 102.

Thereafter, when the valve body 102 is displaced by g2 and the upper end surface 404*c* of the movable iron core 404 contacts the lower end surface 401*g* of the fixed iron core 401, the intermediate member 414 is displaced upward, and the movable iron core 404 is displaced downward to contact again and then move away again; and the valve body 102 is displaced upward and the movable iron core 404 is displaced downward, and thereafter the displacement of the valve body 102 is stabilized to g2.

(Action, Effect)

In the present embodiment, the intermediate member 414 is provided below the third spring member 406 that generates a spring force on the movable iron core 404 and the valve body 102, the intermediate member 414 being arranged to contact the bottom surface 404*b*' of the recess 404*b* of the movable iron core 404 and the upper surface 102*b* of the large-diameter portion 102*a* of the valve body 102. Therefore, when the movable iron core 404, the valve body 102, and the intermediate member 414 perform a valve opening operation and the movable iron core 404 collides with the fixed iron core 401, the movable iron core 404 moves in the valve closing direction, while the intermediate member 414 and the valve body 102 continue to move in the valve opening direction. In this state, no spring force acting between the movable iron core 404 and the valve body 102 is generated, so that a state in which a spring force is separated is created. Therefore, a spring force that changes with the movement of the movable iron core 404 is not transmitted to the valve body 102, and conversely a spring force that changes with the movement of the valve body 102 is not transmitted to the movable iron core 404, so that the two independently vibrate with collision. Also, when the two collide with each other again, the movable iron core 404 bounces again in the valve closing direction and the valve body 102 bounces again in the valve opening direction, but the two do not give and receive a force and move without acting spring forces that change with the movement of them, and the forces held by the valve body 102 and the movable iron core 404 are small. Therefore, the bounce of the movable parts converses faster than in the case where spring forces that change with the movements of each other act. With this effect, a fuel injection amount can be stabilized.

Further, in the valve closed state, the gap g1 by which the movable iron core 404 is displaced is constituted by the difference between the height 414*h* of the step of the recess of the intermediate member 414 and the height h of the large-diameter portion 102*a* (height h between the upper surface 102*b* and the lower surface 102*c* of the large-diameter portion 102*a*) of the valve body 102, that is, the gap g1 is determined by the dimensions of parts; and hence adjustment in the assembly process is not required, so that the assembly process can be simplified.

When the power supply to the coil 402 is cut off, the magnetic force starts to disappear, and the valve is closed by the biasing force of the spring in the valve closing direction. After the displacement of the valve body 102 becomes 0, the valve body 102 contacts the valve seat 301*a*, and the valve is completely closed. Since the intermediate member 414 contacts the upper surface 102*b* of the large-diameter portion 102*a* of the valve body 102, the displacement does not become smaller than 0.

On the other hand, the movable iron core 404 is further displaced in the valve closing direction even after the displacement of the intermediate member 414 becomes 0. After the movable iron core 404 is most displaced in the valve closing direction, it is displaced in the valve opening direction by the second spring member 407 such that the displacement becomes 0 again. The displacement becomes 0 again, and the movable iron core 404 collides with the intermediate member 414.

In the configuration of the present embodiment, the outer diameter 414D of the intermediate member 414 is made smaller than the inner diameter 401D of the fixed iron core 401. Therefore, in assembling the fuel injection device 100, the plunger cap 410, the valve body 102, the third spring member 406, and the intermediate member 414 can be integrated into one piece in advance and can be incorporated into the fuel injection device 100 after the gap g1 is determined by the height 414*h* of the step of the recess of the intermediate member 414 and the height h of the large-diameter portion 102*a* of the valve body 102, and in a state in which the spring force adjusting member 106 and the first spring member 405 are not inserted; and hence the gap g1 can be stably managed while the assembly is made easy. In the present embodiment, the outer diameter 414D of the intermediate member 414 is set to be smaller than the inner diameter 401D of the fixed iron core 401, but it is only required that the outermost diameter of a member to be assembled in advance is made smaller, and if the outermost diameter of the plunger cap 410 is larger than the outer diameter 414D of the intermediate member 414, the outermost diameter of the plunger cap 410 may be smaller than the inner diameter 401D of the fixed iron core 401.

In the present invention, even if the movable iron core 404 has the same surface as the upper end surface 404*c* without the recess 404*b*, the same action effects as the present invention can be obtained. The reasons why the recess 404*b* of the movable iron core 404 is provided are that: the intermediate member 414 can be arranged on the further lower side; the length in the valve opening and closing direction of the valve body 102 can be shortened; and the valve body 102 that is accurate can be configured.

Second Embodiment

Next, the configuration of a fuel injection device according to a second embodiment of the present invention will be described with reference to FIG. 3.

Figure 3:
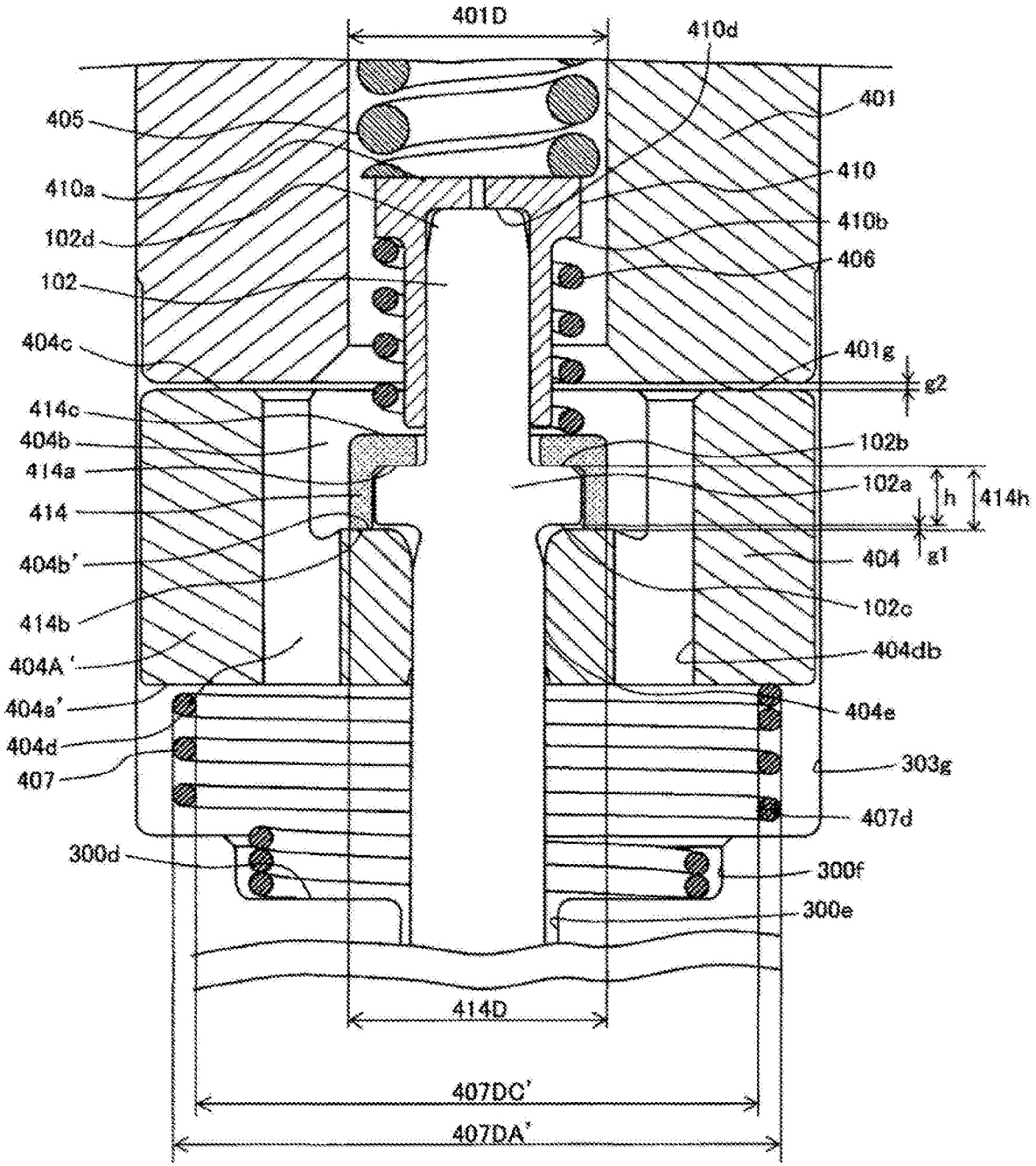
FIG. 3 is a view for explaining the vicinity of a movable iron core of a fuel injection device according to a second embodiment of the present invention, and is a cross-sectional view illustrating in an enlarged manner a portion corresponding to the electromagnetic drive unit of the fuel injection device illustrated in FIG. 1.

FIG. 3 is a view for explaining the vicinity of a movable iron core of a fuel injection device according to a second embodiment of the present invention, and is a cross-sectional view illustrating in an enlarged manner a portion corresponding to the electromagnetic drive unit of the fuel injection device illustrated in FIG. 1. In FIG. 3, the parts having the same numbers as those in the first embodiment have no difference in configurations and action effects, and hence description thereof will be omitted. In FIG. 3, hatching of the valve body 102 is omitted for easy viewing, similarly to FIG. 2.

In the present embodiment, a second spring member 407 is formed such that its outer diameter is increased from the lower end portion toward the upper end portion. In the present embodiment, a nozzle body 303*b* having the shape illustrated in FIG. 3 is used instead of the nozzle body 300*b* of the first embodiment. When the upper end portion of the biasing spring (second spring member 407) is located radially outside the fuel passage hole 404*d*, the regulating unit is an inner peripheral portion 303*g* of the nozzle body 303*b*, and the biasing spring (second spring member 407) is formed such that the shortest distance between an inner peripheral portion 407DC' of the upper end portion of the second spring member 407 and an outermost peripheral portion 404*db* of the exit surface of the fuel passage hole 404*d* is larger than the radial travel distance between an outer diameter portion 407DA' of the upper end portion and the inner peripheral portion 303*g* of the nozzle body 303*b*.

With the configuration of the present embodiment, the upper end portion of the second spring member 407 is located radially outward with respect to the fuel passage hole 404*d* of the movable iron core 404, whereby the upper end portion of the second spring member 407 can be prevented from overlapping the fuel passage hole 404*d* of the movable iron core 404, so that the upper end portion can be prevented from being caught by the fuel passage hole 404*d*. Thereby, the upper end portion of the second spring member 407 does not overlap the lower surface of the fuel passage hole 404*d* even if the second spring member 407 is arranged such that its spring axis direction is inclined from the vertical direction toward a direction going to the portion opposite to the winding end portion, and hence the movable iron core 404 can be suppressed from being eccentric. Therefore, uneven wear of the sliding portion between the movable iron core 404 and the valve body 102 can be suppressed, and as a result, fuel sealability can be suppressed from deteriorating.

The present invention is not limited to the above embodiments, and various modifications are included.

For example, the above embodiments have been described in detail for easy understanding of the present invention, and they are not necessarily limited to those including all the configurations described above. Additionally, part of the configuration of a certain embodiment can be replaced with the configuration of another embodiment, or the configuration of a certain embodiment can be combined with the configuration of another embodiment. Additionally, part of the configuration of each embodiment can be added, deleted, or replaced for another configurations.

REFERENCE SIGNS LIST

100 fuel injection device
101 fuel passage
102 valve body
200 fuel supply unit
300 nozzle unit
301*a* valve seat
301*b* fuel injection hole
311 movable iron core receiving unit
400 electromagnetic drive unit
401 fixed iron core
402 coil
403 housing
404 movable iron core
405 first spring member
406 third spring member
407 second spring member
414 intermediate member

The invention claimed is:

1. A fuel injection device comprising:

a valve body configured to open and close a fuel flow path;

a movable iron core in which a fuel passage hole for communicating an upstream side and a downstream side is formed, and that is configured to operate the valve body toward the upstream side;

a biasing spring whose upper end portion contacts the movable iron core, and that biases the movable iron core in a valve opening direction;

a regulator configured to regulate movement of the upper end portion of the biasing spring; and a nozzle body, wherein a shortest radial distance between the upper end portion of the biasing spring and the fuel passage hole is larger than a radial travel distance of the upper end portion until radial movement of the upper end portion is regulated by the regulator, wherein the upper end portion has a smaller radial diameter than that of a lower end portion of the biasing spring below the upper end portion, the upper end portion is entirely radially inward from the fuel passage hole, the upper end portion having a constant radial diameter, and the lower end portion having a constant radial diameter, wherein the upper end portion and the lower end portion are arranged to form a gap between the lower end portion and an inner peripheral portion of the nozzle body, and to form a gap between the upper end portion and an outer peripheral portion of the valve body, wherein the gap between the lower end portion of the biasing spring and the inner peripheral portion of the nozzle body is narrower than the gap between the upper end portion of the biasing spring and the outer peripheral portion of the valve body.

2. The fuel injection device according to claim 1, wherein when a central axis of the biasing spring and a central axis of the valve body are on the same axis line, the shortest radial distance between the upper end portion and the fuel passage hole is larger than the radial travel distance of the upper end portion.

3. The fuel injection device according to claim 1, wherein:

the regulator is the outer peripheral portion of the valve body; and when the upper end portion of the biasing spring is located radially inward with respect to the fuel passage hole, the shortest radial distance between an outer peripheral portion of the upper end portion of the biasing spring and an innermost peripheral portion of the fuel passage hole is larger than the radial travel distance of the upper end portion of the biasing spring, the radial travel distance being between an inner peripheral portion of the upper end portion and the outer peripheral portion of the valve body.

4. The fuel injection device according to claim 1, wherein an outer diameter of the biasing spring is reduced from the lower end portion of the biasing spring opposite to the upper end portion toward the upper end portion.

5. The fuel injection device according to claim 4, wherein in the biasing spring, an axial length of the upper end portion is larger than an axial length of the upper lower end portion.

* * * * *